United States Patent [19]

Nivin

[11] Patent Number: 4,537,147

[45] Date of Patent: Aug. 27, 1985

[54] PLASTIC SHEET BARGE HATCH COVER

[75] Inventor: James E. Nivin, Louisville, Ky.

[73] Assignee: American Commercial Barge Line Co., Jeffersonville, Ind.

[21] Appl. No.: 646,045

[22] Filed: Aug. 31, 1984

Related U.S. Application Data

[63] Continuation of Ser. No. 459,204, Jan. 19, 1983, abandoned.

[51] Int. Cl.[3] ..... B63B 19/12

[52] U.S. Cl. ..... 114/201 R; 4/503

[58] Field of Search ..... 114/201 R, 203, 361; 441/40, 41, 90, 88; 4/498–503; 414/141; 135/87, 93, 119

[56] References Cited

U.S. PATENT DOCUMENTS

| | | | |
|---|---|---|---|
| 524,137 | 8/1894 | Enright | 114/361 |
| 1,448,527 | 3/1923 | Edmonds | 441/88 |
| 2,883,676 | 4/1959 | Kwake | 4/503 |
| 3,353,309 | 11/1967 | Kwake | 4/499 |
| 3,405,814 | 10/1968 | Yanow | 414/141 |
| 3,475,772 | 11/1969 | Lokken | 114/361 |
| 3,523,308 | 8/1970 | Bradley | 4/503 |
| 3,732,581 | 5/1973 | Pitti et al. | 4/503 |
| 4,130,125 | 12/1978 | Nivin | 114/201 R |
| 4,292,913 | 10/1981 | Siebert et al. | 114/361 |

*Primary Examiner*—Jesus D. Sotelo

*Attorney, Agent, or Firm*—Laurence R. Brown

[57] ABSTRACT

The open hatch of barges is covered by a plastic sheet with plastic piping formed about the edges to receive water for weighting the sheet down on the hatch coaming rim and sealing the sheet in place. The plastic pipes comprise hollow folded over plastic pipes terminating at tapered ends on each side of a rectangular shaped sheet to form filling pipe structure and simple drawstring closure valving to be disposed above water level. Drainage pipes in the barge coaming receive plastic drain sleeves forming passageways from the upper sheet surface to remove any collected rainwater. Plastic air socks located on opposite ends and extending through the sheet permit a blower fan to tent up the sheet in transit for draining rainwater over the edge of the coaming.

4 Claims, 8 Drawing Figures

FIG.4
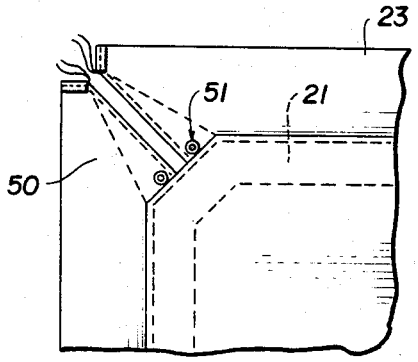
FIG.5
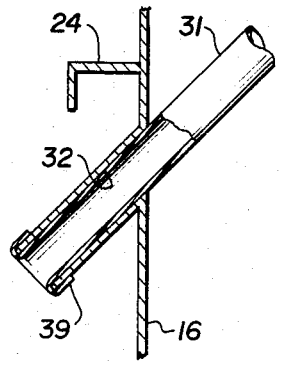
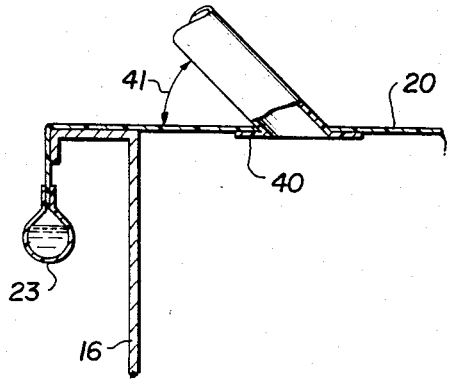
FIG.6
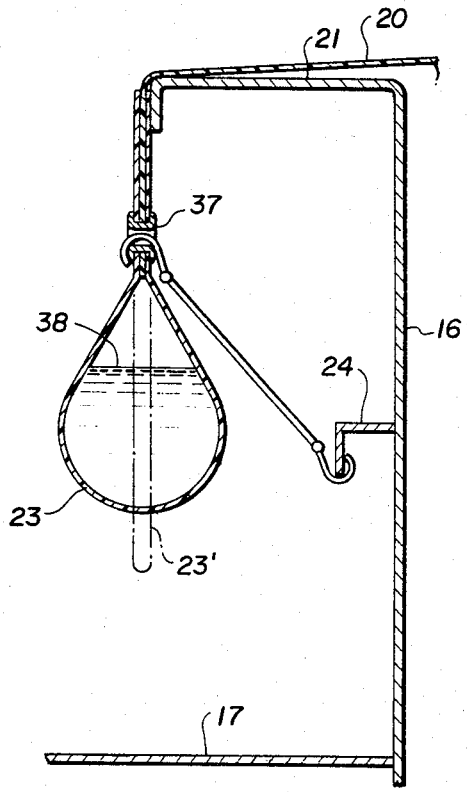
FIG.8

PLASTIC SHEET BARGE HATCH COVER

This application is a continuation application of Ser. No. 459,204 filed Jan. 19, 1983 by James E. Nivin entitled PLASTIC SHEET BARGE HATCH COVER and now abandoned.

FIELD OF THE INVENTION

This invention relates to hatch covers, and more particularly it relates to hatch covers comprising plastic sheets.

BACKGROUND ART

To reduce the weight of barge hatch covers it has been proposed that light-weight plastic sheeting be used in tentlike arrays as evidenced by my U.S. Pat. No. 4,130,125 issued Dec. 19, 1978. Other tentlike hatch covers are shown in U.S. Pat. Nos. 3,405,814—H. H. Yanow—Oct. 15, 1968 and 524,137—M. Enright — Aug. 7, 1894.

Barge hatches are typically over 50 meters (150 ft.) long and about 10 meters (30 ft.) wide. Thus, metal covers are very heavy and expensive. Furthermore, they are time and cost consuming to use and store. Thus, portable, light-weight, low-cost hatch covers are desirable to protect such cargos as salt, grain, etc. which are to be protected from rainwater during transport.

Prior art tentlike hatch covers partly satisfy the needs but introduce several problems. They are difficult to erect because of the tent pole framework structure, and special structure need be supplied for in-transit use. The framework must be stored, and is costly and need be erected and taken down.

Furthermore the tent framework exposes the hatch cover to wind and thus must be securely braced to prevent flapping or collapse. Also, it is preferable to prevent the sail effect that gathers the wind in a superstructure assembly.

One of the most serious problems with tenting is that of anchoring the tent to the deck or coaming about the hatch in a strong leak-proof seal. Strong wind gusts may tear loose tie down straps, etc. in light-weight plastic, and permit rainwater to be blown into torn gaps.

Accordingly, this invention has as its objective the improvement of the art by overcoming the foregoing problems and providing a simplified easy to install light-weight plastic hatch cover compatible with the conditions encountered in barge transport.

DISCLOSURE OF THE INVENTION

A light-weight reinforced plastic film barge hatch cover is afforded by this invention that is inexpensive, light-weight, and easy to install, and provides a uniform and continuous seal between the coaming about the barge hatch and the cover. The edge of the cover, which overlaps the edge of the coaming to hang therebelow by gravity, forms a pipe or tube running around the length and width of the coaming. The tube is filled with river water to create a hanging hydrostatic weight that seals the edge of the coaming, provides uniform tension throughout the plastic cover and holds the cover firmly in place.

Other plastic cover features include means for draining water from the cover, simple drawstring pipe closure structure for retaining the water in the tubes, reinforced bearing surfaces at the coaming edge, a blower for ridging the center tentlike for rainwater drainage over the edge of the coaming and temporary grommet hook structure to facilitate mounting the cover, particularly under windy conditions.

Thus, the hatch cover typically over 50 meters (170 ft.) long and 10 meters (30 ft.) wide may be simply installed and stored aboard a barge by two men, without use of crane or special tools, and the light-weight does not materially interfere with cargo carrying capacity. The plastic cover is conveniently folded along its lengths and rolled toward midship when not in use, and while the barge is loaded.

Other features, advantages and objectives of the invention will be found throughout the drawing, claims and following description.

BRIEF DESCRIPTION OF THE DRAWINGS

In the drawings:

FIG. 4 is a fragmental plan enlarged view of a corner of the barge showing the plastic cover edge pipe end structure before filling with water;

FIG. 5 is a fragmental section view through the barge coaming and interfitting drainage tube from the plastic cover;

FIG. 6 is a fragmental side line section sketch showing an air vent pipe for use to tent or ridge the plastic cover for shedding rainwater;

FIG. 8 is an enlarged section fragment showing hooking structure for temporarily holding the cover in place during installation.

THE PREFERRED EMBODIMENT

Figure 1:
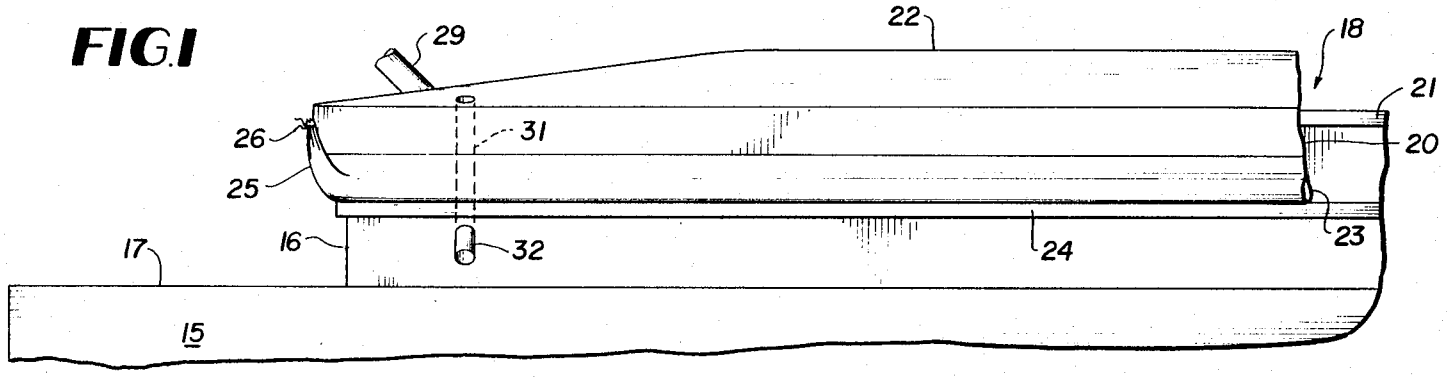
FIG. 1 is a partial profile side view sketch of a barge with the plastic cover provided by this invention in place.

As may be seen from the side view of barge 15 in FIG. 1, the coaming 16 extends above deck 17 about the hatchway 18, typically about 50 meters long and 10 meters wide. In accordance with this invention, a reinforced thin film plastic hatch cover 20 is fitted over and sealed with the rim 21 of coaming 16 in such fashion as to allow tenting or ridging 22 over the cargo area thereby to run off rainwater over the edge of the coaming.

The plastic cover at its outer edges in a position which overhangs the coaming rim 21 and falls between the rim and deck 17 forms a pipe or tubing 23, which when filled with water holds the cover in place and seals the cover plastic 20 over the coaming rim 21. A flange 24 along the coaming serves in a manner later described to temporarily hold the cover 20 in place during mounting and before tubing 23 is filled with water to serve as the cover seating medium. The ends 25 of tubing 23 at the corners are tapered and supplied with closure drawstrings 26 as inexpensive closure valves. They will be later described.

Figure 2:
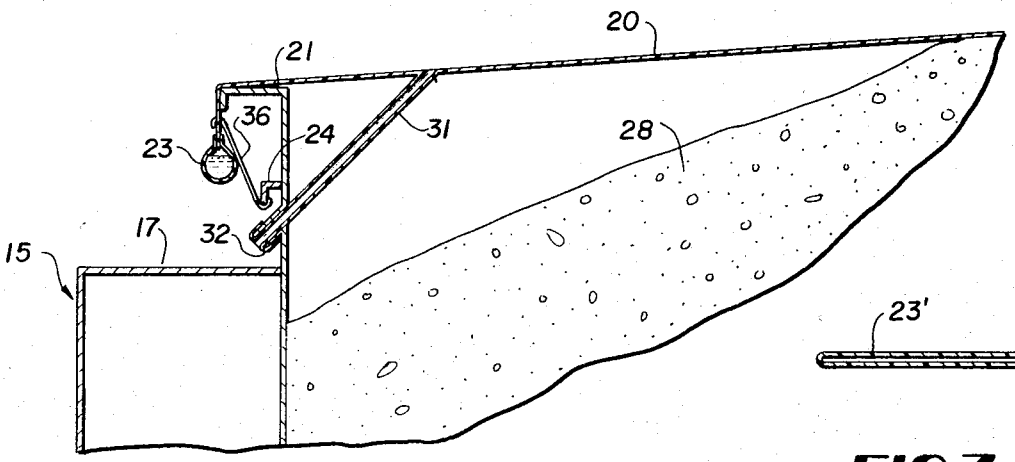
FIG. 2 is a partial end view sketch showing a line diagram section view of the barge with plastic cover in place.

Since the thin plastic sheet cover proposed by this invention tends to sag and accumulate rainwater, provision is made to shed water. If a full cargo 28 (FIG. 2) extends above the plane of the coaming rim 21 it will tent or ridge the plastic as shown at 22 so that water will run off the rim 21 of the coaming 16. If this be not the case, then by means of the air pipe-vent 29 installed in each end of the plastic cover 20 and a connected air blower 30 (FIG. 7) at one end, the cover is tented at 22 by air pressure and vented by the air-pipe-vent 29 at the opposite end, thereby to shed rainwater during transit. As seen in the detailed sketch of FIG. 6, the vent pipe is preferably lapped over inside the cover 20 as shown at 40 and extends at an angle 41 of about 45° from the plane of the cover sheet.

Further to eliminate any water gathering on the upper surface of the plastic cover 20, plastic drain sleeves 31 are formed in the cover near the edges at appropriate intervals such as 10 meters. These sleeves 31 mate with and interfit through pipes 32 extending through the coaming 16, as better seen in the FIG. 2 section view. Also better seen in this view is the flange 24 which engages a hooked line 36 engaged at the other end in grommets 37 spaced about the edge of the plastic cover as shown in more detail in FIG. 8. The detail section view of FIG. 5 shows the piping 30 extending from coaming 16 with the sleeve 31 mated thereinto and rolled over at the end 39.

This serves to temporarily hold the plastic sheet cover 20 in place during installation before the tubing 23 is filled with water 38 as shown in phantom line view 23'. Thus, even in windy conditions the cover is easily installed by few hands in temporary condition to permit filling the tubing 23 with water to seal the cover in place over the rim 21.

Figure 7:
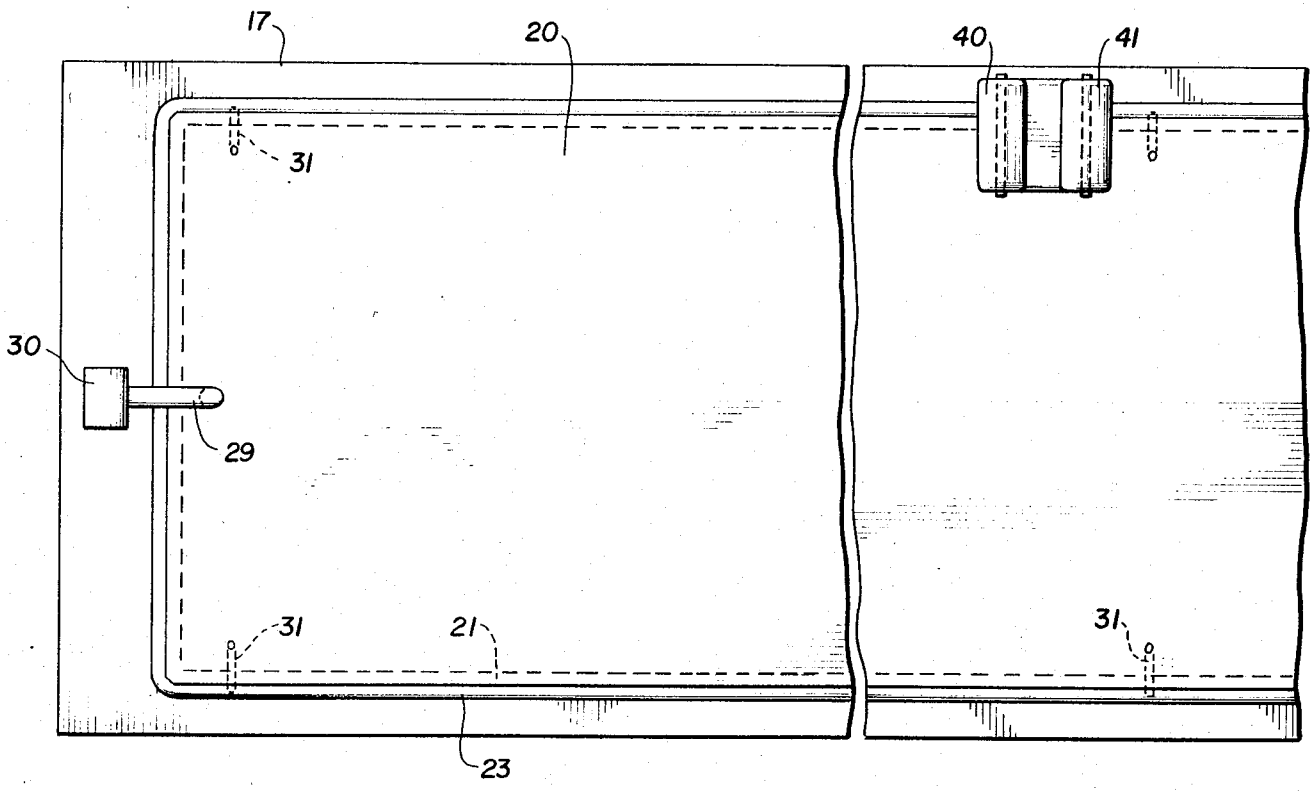
FIG. 7 is a partial plan view of the barge and covered hatch.

As seen from FIG. 7, the plastic cover is accordion folded along its length in about 1.25 meter (4 ft.) strips and rolled on cores from each end into two rolls 40, 41 shown superimposed amidships in storage position on the rim of the coaming. They are simply unrolled, hooked on the storage side, and unfolded across the hatch, typically with two deck hands, and hooked in place for the next water filling step.

Figure 3:
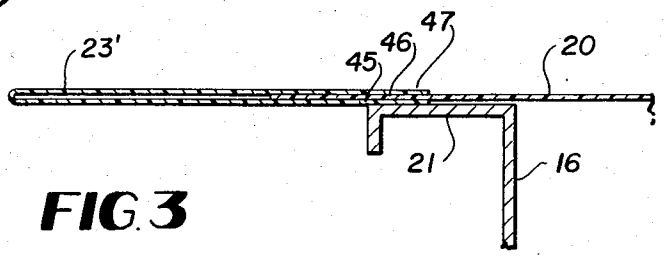
FIG. 3 is a fragmental section enlarged view of the interface between the plastic cover and the coaming rim.

As shown in FIG. 3, the plastic tubing is preferably formed by sealing three plies of plastic film 45, 46, 47 at the position the cover 20 engages the rim 21 of coaming 16, to thereby provide a more rugged wear and seal surface not as subject to wear and tear.

For filling plastic tubing 23 with water, the tubing need be vented at one end and there must be valve structure for holding the water in the tubing after filling. With typically a 45 cm (18 inch) flat width of tubing 23' as shown in FIGS. 3 or 8, the ends are tapered down (at 50 in FIG. 4) to fit a three inch diameter portable water pump for dipping into the river for filling the tubes 23.

Thus, the corner structure as shown in FIG. 4 provides a base for filling two edge tubes, or alternatively for venting two edge tubes as they are being filled. For this reason as seen from FIGS. 1 and 4 the drawstrings 26 provide a simple closure valve which together with grommets 51 permit the ends tapered 25, 50 to be tied above the water level in tubes 23 to vent the tubes 23 and retain the water therein after filling.

Having therefore advanced the state of the art in the manner aforesaid those features of novelty believed descriptive of the spirit and nature of the invention are defined with particularity in the claims.

I claim:

1. A hatch cover that withstands the wind, rain and other in transit and storage conditions encounted by in-water barges which hatch cover can be installed and stored on deck in limited space by two deck hands on open hatch barges having a rimmed coaming extending above the deck about a hatchway to form a substantially rectangular hatch occupying a large portion of the total deck area, comprising in combination, a substantially rectangular thin film plastic sheet for covering the hatch by extending over the rim of the coaming about the hatchway, four watertight plastic pipe sections formed by hems along substantially the entire edge of said sheet located with the sheet hems for overhanging substantially the entire coaming to hang over the coaming in a position between the coaming rim and the deck and being watertight of such dimensions for filling with water of enough weight and storing it to hold down the edges of the sheet over the coaming edge to seal the hatch and hold the plastic sheet in place with uniform tension while the barge is in transit encountering said in transit conditions, and including for each of the four pipe sections formed by the hems valving structure located for filling and venting the respective pipe sections disposed near opposite ends of the respective pipe sections respectively for rapidly filling one end of the pipe sections with water adjacent the barge by pumps and venting the opposite end and thereafter retaining the water therein for holding the plastic sheet in place covering the hatch, said valving structure on said pipe sections comprising a tapered section extending from each piping section at the rectangle corners, and retaining the water comprising a drawstring for substantially closing the tapered ends of the piping together with means for holding the substantially closed drawstring end of the tapered section at a level above the pipe sections formed by said hem when the pipe sections are filled with water and in place overhanging the coaming.

2. A hatch cover sheet as defined in claim 1 with said rectangular shape of a length over 50 meters and a width in the order of 10 meters, and with the plastic piping comprising a folded over plastic member with a hem line to the edge of the sheet in the order of 45 cm width.

3. A hatch cover sheet as defined in claim 2 wherein the hem portion of the piping overlaps the coaming rim to provide a three ply long wearing plastic bearing surface on the coaming rim.

4. A hatch cover anchored by the water filled piping as defined in claim 1 including two air sock openings through the plastic sheet near opposite ends of the sheet respectively adapted for connection of an air blower therein to one said opening as an air input conduit and for controlled discharge of air from an outlet vent at a rate so that the center of the sheet may be tented to run off rainwater over the edge of the coaming by air from a blower into the input conduit.

* * * * *